US011047214B2

(12) United States Patent
Gray et al.

(10) Patent No.: US 11,047,214 B2
(45) Date of Patent: Jun. 29, 2021

(54) SYSTEMS AND METHODS FOR DRILLING PRODUCTIVITY ANALYSIS

(71) Applicant: GE Energy Power Conversion Technology Ltd., Warwickshire (GB)

(72) Inventors: Stuart Gray, Houston, TX (US); David Johnson, North Houston, TX (US); David Huezo, North Houston, TX (US); Krishna Uppuluri, San Ramon, CA (US)

(73) Assignee: GE ENERGY POWER CONVERSION TECHNOLOGY LTD., Warwickshire (GB)

( * ) Notice: Subject to any disclaimer, the term of this patent is extended or adjusted under 35 U.S.C. 154(b) by 116 days.

(21) Appl. No.: 15/419,026

(22) Filed: Jan. 30, 2017

(65) Prior Publication Data

US 2018/0216440 A1 Aug. 2, 2018

(51) Int. Cl.

| | |
|---|---|
| ***E21B 44/00*** | (2006.01) |
| ***E21B 47/00*** | (2012.01) |
| ***E21B 41/00*** | (2006.01) |
| *E21B 45/00* | (2006.01) |

(52) U.S. Cl.

CPC ..... *E21B 41/0092* (2013.01); *E21B 44/00* (2013.01); *E21B 47/00* (2013.01); *E21B 41/00* (2013.01); *E21B 45/00* (2013.01)

(58) Field of Classification Search

CPC ..... E21B 44/00; E21B 47/00

See application file for complete search history.

(56) References Cited

U.S. PATENT DOCUMENTS 6,892,812 B2 5/2005 Niedermayr et al.
9,404,356 B2 8/2016 Benson et al.

(Continued)

FOREIGN PATENT DOCUMENTS

WO 2015/002905 A2 1/2015

OTHER PUBLICATIONS

"Active Performance Benchmarking with Halliburton's MaxActivity Analysis Tool Facilitates Step-Change Performance for Operator and Saves $20 Million," Halliburton Sperry Drilling Retrieved from URL: https://www.landmark.so1utions/Portals/O/LMSDocs/CaseStudies/2011-max-activity-drilling-optimization-case-study.pdf, pp. 1-2 (Dec. 31, 2011).

(Continued)

*Primary Examiner* — Robert E Fuller
*Assistant Examiner* — Lamis Quaim
(74) *Attorney, Agent, or Firm* — Wood IP LLC

(57) ABSTRACT

There is provided a system for analyzing and controlling a productivity of a drilling apparatus. The exemplary system includes a processor and a memory including instructions that cause the processor to perform certain operations. The operations can include receiving information from a control system of the drilling apparatus and determining a key performance metric based on the information. The operations can further include performing a comparison between the key performance metric and at least one other key performance metric. Furthermore, the operations can further include instructing, based on the comparison, the control system to alter the productivity of the drilling apparatus.

14 Claims, 6 Drawing Sheets

(56) References Cited

U.S. PATENT DOCUMENTS

| | | | | |
|---|---|---|---|---|
| 2011/0153296 | A1* | 6/2011 | Sadlier | E21B 44/00 703/7 |
| 2014/0246238 | A1 | 9/2014 | Abbassian et al. | |
| 2015/0029034 | A1* | 1/2015 | Abbassian | E21B 44/00 340/853.2 |
| 2015/0107899 | A1 | 4/2015 | Fisher, Jr. et al. | |
| 2017/0328178 | A1* | 11/2017 | Lucas | E21B 44/00 |
| 2018/0156023 | A1* | 6/2018 | Dykstra | E21B 7/04 |

OTHER PUBLICATIONS

Zafar, S.H.,et al., "KPI Benchmarking—A Systematic Approach", AADE 2009 National Conference and Exhibition New Orleans, Retrieved from the Internet URL:https://www.slb.com/-/media/Files/technical_papers/2009/09ntce0704. pdf, pp. 1-7 (Apr. 2009).

Extended European Search Report and Opinion issued in connection with corresponding EP Application No. 18154019.6 dated Jun. 25, 2018.

* cited by examiner

SYSTEMS AND METHODS FOR DRILLING PRODUCTIVITY ANALYSIS

I. TECHNICAL FIELD

The present disclosure relates to drilling equipment and assets. More particularly, the present disclosure relates to systems and methods for analyzing drilling productivity.

II. BACKGROUND

Drilling processes can be monitored in real time. Nevertheless, the information obtained from typical monitoring systems is typically not used to its full potential, and drilling can be thought of as an art rather than a science. Specifically, based on the information reported by a typical monitoring system, an operator may adjust the drilling process in order to obtain a desirable outcome, but such an adjustment is subjective and is most likely far from the optimum adjustment that would be needed. As such, the productivity of drilling systems, especially for the ones deployed offshore, are often not optimized. This lack of optimization can lead to increased production costs as a result of the inherent inefficiencies that exist in the drilling production cycle.

III. SUMMARY

The embodiments featured herein help solve or mitigate the above noted issues as well as other issues known in the art. For example, an embodiment includes a system developed to determine productivity in an offshore drilling operation. By using instrumentation from onboard control and automation systems, the sequence of operation is determined and analyzed to produce key performance indicators that provide insight into operational efficiency and equipment health.

Such an embodiment removes the "art" in drilling, thus changing the process from art to science. Specially, with the embodiments, commercial model drilling companies can have increased visibility of the inefficiencies in their operation. Furthermore the embodiments can provide trending operations that are selectable over previous time periods thereby allowing vessel operations to be bench-marked.

For example, the embodiments allow a drilling contractor to measure and optimize their drilling process. As a result, they can remove inefficiencies from their operations and drill wells faster. As certain aspects of offshore drilling are not in the control of the drilling contractor and are instead, directed by the oil company, the embodiments will allow drilling contractors to break out the aspects that they are in control of, optimize them and therefore enable them to predict durations for upcoming drilling projects. This will allow a drilling contractor to be selected for contracts based on performance and even potentially take on fixed price contracts rather than day rates.

One embodiment provides a system for analyzing and controlling a productivity of a drilling apparatus. The exemplary system includes a processor and a memory including instructions that cause the processor to perform certain operations. The operations can include receiving information from a control system of the drilling apparatus and determining a key performance metric based on the information. The operations can further include performing a comparison between the key performance metric and at least one other key performance metric. Furthermore, the operations can further include instructing, based on the comparison, the control system to alter the productivity of the drilling apparatus.

Another embodiment provides a method for analyzing and controlling a productivity of a drilling apparatus utilizing a control system interfaced with the drilling apparatus. The exemplary method includes determining a key performance metric based on information received by the control system, the information being indicative of a state of the drilling apparatus. The method further includes performing a comparison between the key performance metric and at least one other key performance metric. The method can also include altering, by the control system and based on the comparison, the productivity of the drilling apparatus.

Additional features, modes of operations, advantages, and other aspects of various embodiments are described below with reference to the accompanying drawings. It is noted that the present disclosure is not limited to the specific embodiments described herein. These embodiments are presented for illustrative purposes only. Additional embodiments, or modifications of the embodiments disclosed, will be readily apparent to persons skilled in the relevant art(s) based on the teachings provided.

IV. BRIEF DESCRIPTION OF THE DRAWINGS

Illustrative embodiments may take form in various components and arrangements of components. Illustrative embodiments are shown in the accompanying drawings, throughout which like reference numerals may indicate corresponding or similar parts in the various drawings. The drawings are only for purposes of illustrating the embodiments and are not to be construed as limiting the disclosure. Given the following enabling description of the drawings, the novel aspects of the present disclosure should become evident to a person of ordinary skill in the relevant art(s).

V. DETAILED DESCRIPTION

While the illustrative embodiments are described herein for particular applications, it should be understood that the present disclosure is not limited thereto. Those skilled in the art and with access to the teachings provided herein will recognize additional applications, modifications, and embodiments within the scope thereof and additional fields in which the present disclosure would be of significant utility.

Figure 1:
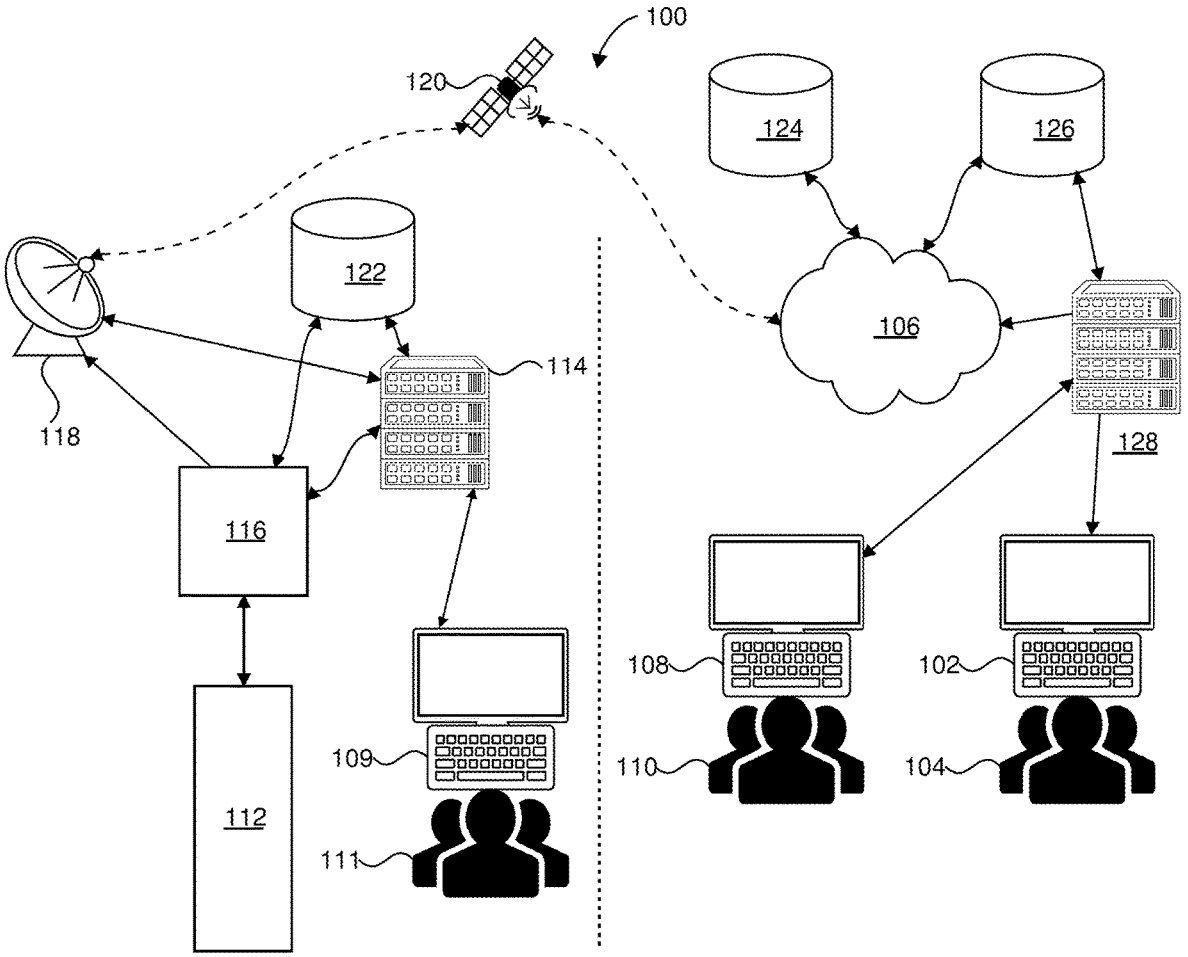
FIG. 1 illustrates a drilling environment in accordance with several aspects described herein.

FIG. 1 illustrates an environment 100 in which several embodiments may be used. The environment 100 features a plurality of components or assets that may be deployed in oil and gas drilling operations. Some components can be onshore, depicted on the right side (denoted "B") of the dotted line in FIG. 1, and some can be offshore on a drill ship or the like, depicted on the left side (denoted "A") of the dotted line. Together, the onshore and offshore components operate to provide several functions and to conduct several processes or sub-processes that are useful in oil and gas drilling operations, as shall be described in greater detail below.

The offshore components can include a plurality of systems. In FIG. 1, for example, the offshore components include a drilling control system 116, a server 114, a drilling apparatus 112, an operational database 122, and an antenna 118. The drilling apparatus 112 can be partly submerged in order to allow an operator to drill through a submerged hard surface. The antenna 118, the control system 116, the operational database 122, and the server 114 can be located on a drill ship or on an ocean-based drilling platform, and they can be linked to the drilling apparatus 112. For example and not by limitation, the drilling apparatus 112 may include an umbilical system for providing power, hydraulic, and communications support. Or, for example and not by limitation, the drilling apparatus may include multiple equipment and hardware that are located on a rig or below the ocean, all of which function to provide and/or support drilling operations. The antenna 118 can provide connectivity between the offshore components and the onshore components via a satellite 120.

The onshore components of the environment 100 can include a plurality of control terminals (e.g., a computer 102 and a computer 108) for monitoring and controlling one or more offshore systems. The computer 102 and the computer 108 are connectable to the satellite 120 via a server 128 and a network 106. The onshore components of further include a plurality of databases (e.g., a database 124 and a database 126) that include information about the drilling apparatus 112 and/or information about other drilling systems like the drilling apparatus 112 that are deployed at other locations.

In the exemplary embodiments, any one of technicians 110 or technicians 104 (who may also be offshore) can graphically and/or quantitatively assess the productivity of the drilling apparatus 112 and/or assert commands to the control system 116 in order to increase or lower productivity based on key performance indicators (KPI) obtained from the drilling systems 112 and/or several other factors that can include other KPIs obtained from other drilling apparatuses like the drilling apparatus 112. Similarly, any one of technicians 111 via a computer 109 connected to the server 114 may graphically and/or quantitatively assess the productivity of the drilling apparatus 112 and/or assert commands to the control system 116 in order to increase or lower productivity based on key performance indicators (KPI) obtained from the drilling systems 112 and/or several other factors that can include other KPIs obtained from other drilling apparatuses like the drilling apparatus 112.

In one scenario, one of the users 110 can access a human machine interface (HMI) on the computer 108. The user can query information about one or more subsystems of the drilling apparatus 112 and/or about one or more several processes or sub-processes being conducted or previously conducted by the drilling apparatus 112. The above-mentioned KPIs can be saved as information in any one or more of the aforementioned databases, i.e., either onshore or offshore.

Figure 2:
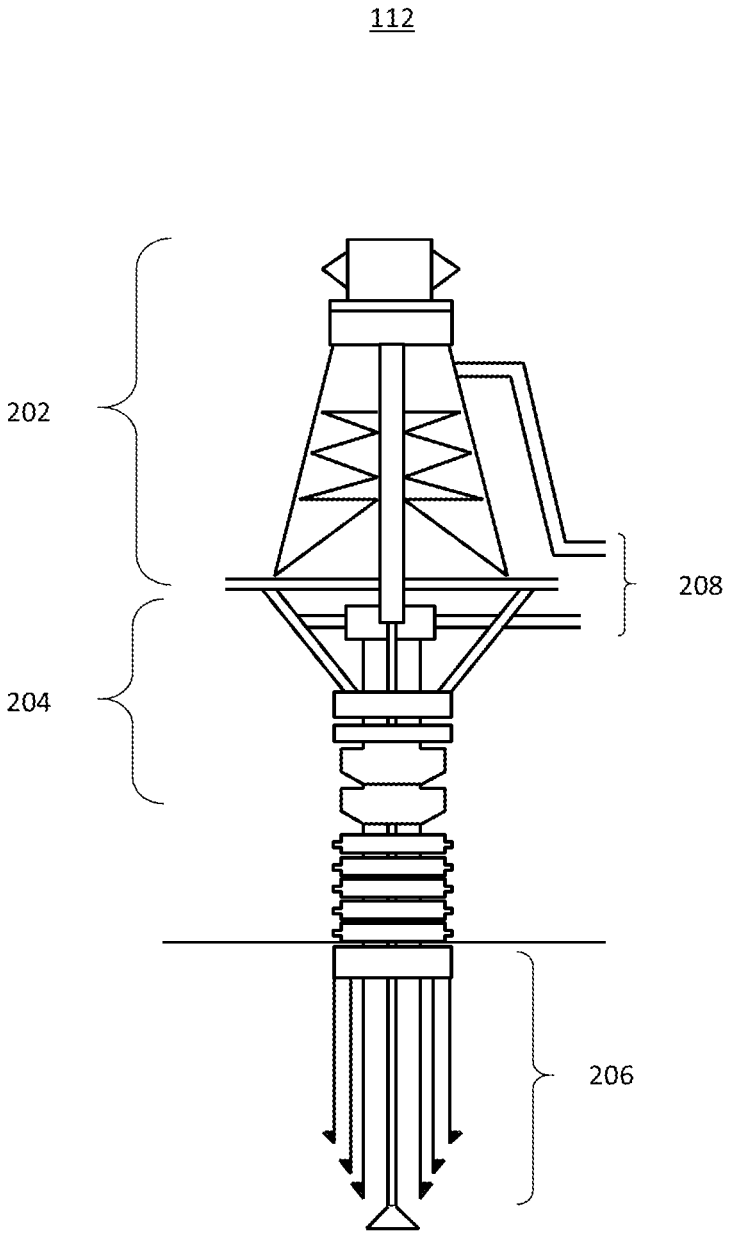
FIG. 2 illustrates an offshore drilling apparatus in accordance with several aspects described herein.

FIG. 2 illustrates the drilling apparatus 112, according to an embodiment. The drilling apparatus 112 can include several control systems distributed in a first section 202, a second section 204, a third section 206, and a fourth section 208. The control systems are generally represented in FIG. 1 as the control system 116. Stated otherwise, the control system 116 represents a computerized control interface for monitoring and changing the state of the several sections of the drilling apparatus 112 mentioned above.

For example, with regards to the first section 202 of the drilling apparatus 112, the control system 116 can be configured to set up drawworks parameters such as hook loads, hook positions, crown mounted compensator (CMC) positions, etc. As such, the control system 116 can be configured to monitor and to change these parameters either by automatic feedback or by the action of one technicians 110. Similarly, the control system 112 can be configured to monitor and control mud return parameters in the second section 204, such as the percentage of mud returned, and to also set gain/loss alarms based on mud return thresholds.

Further, with respect to third section 206, the control system 116 can be configured to monitor and change drilling parameters such as drilled depth, average drilling speed over a predefined period, slip to slip time, and the ratio connection versus movement time. The latter parameters can be actual KPIs associated with the components of the drilling apparatus 112 that are located in the third section 206.

Furthermore, with respect to the fourth section 208, the control system 116 can be configured to monitor and change top drive parameters, mud pump parameters, as well as fetch status indicators of the overall drilling process. These indicators may be for example, and not by limitation, a measure of the current activity (or progress) of one or more drilling processes or sub-processes, weight on bit (WOB), speed references and set points, as well as torque references and set points.

Figure 3:
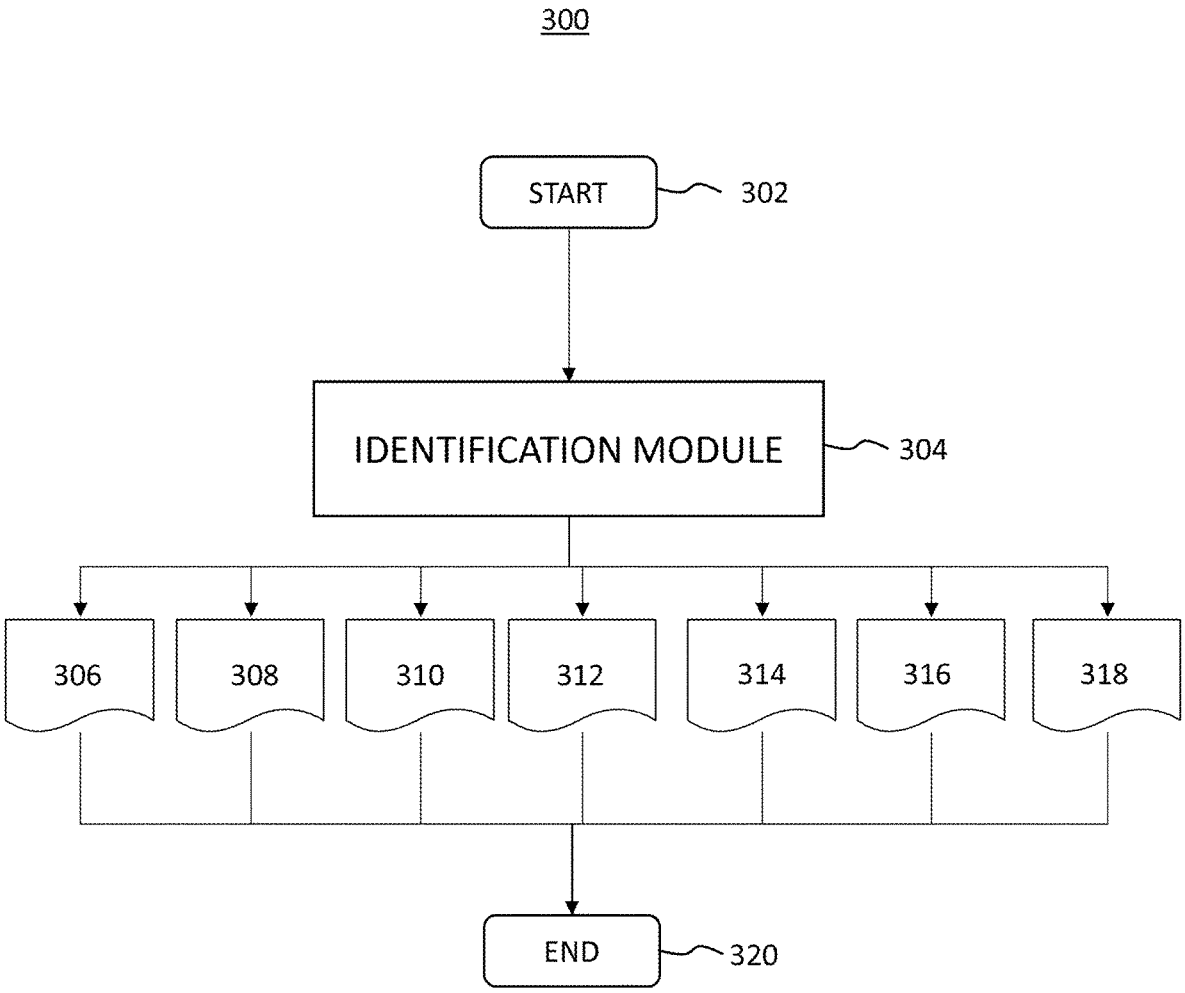
FIG. 3 depicts a flow chart of a method in accordance with several aspects described herein.

FIG. 3 illustrates a routine 300 that may be executed by the control system 116 to identify a drilling process that is ongoing. Specifically, for example and not by limitation, the drilling apparatus 112 may undertake seven (7) different types of processes in the context of drilling (e.g., processes 306, 308, 310, 312, 314, 316, and 318 in FIG. 3). These processes may be, for example, drilling, tripping in, tripping out, running riser, pulling riser, running casing, and wireline, which are processes that are readily identifiable by one of skill in the art. The routine 300 can include an identification module 304 configured to identify which of the seven processes are currently running.

The identification module 304 may make such a determination by receiving data from the various sections of the drilling apparatus 112 and decide, based on the received data, whether a process is being executed. For example, the identification module 304 may receive drill bit speed data from the third section 206 and the first section 202 and determine based on the speed, identify that drilling is currently occurring. Similarly, sensor and equipment state data may indicate whether one of the other seven processes is currently running.

For example, at execution, the routine 300 may start at step 302 and determine via the identification module 304, which one or which ones of processes 306, 308, 310, 312, 314, 316, and 318 are currently running. Upon such determination, the routine 300 ends at step 320 with a list of identifiers indicative of which processes are in progress. As such, an ongoing process may be displayed on the screen of either the computer 102 or the computer 108 via a human machine interface such as a graphical user interface.

For example, once the process 312 has been identified as being in progress, the control system 116 can fetch data from sensors in the section associated with the identified process. The sensor data may be reported from various components in the form tags in a tag module 402. A tag may be information that is indicative of a state of a component. For example, a tag may be raw data indicative of the speed of a drill bit or the pressure measured at a particular location down the bore hole. Based on a predefined relationship between these tags and key performance metrics, the control system 116 may then generate the key performance metrics for the process 312 in a KPI module 404.

The key performance metrics reported in the KPI module 404 may be at least one of WOB, block position, block weight, active heave compensation (AHC) Mode, AHC position, rate of penetration (ROP), top drive speed, top drive torque, stand pipe pressure, mud pump strokes/minute (SPM), mud pump discharge pressure, total SPM, mud return, gain/loss alarms, mud pump designation, average ROP per stand, WOB to WOB, net ROP improvement.

Figure 5:
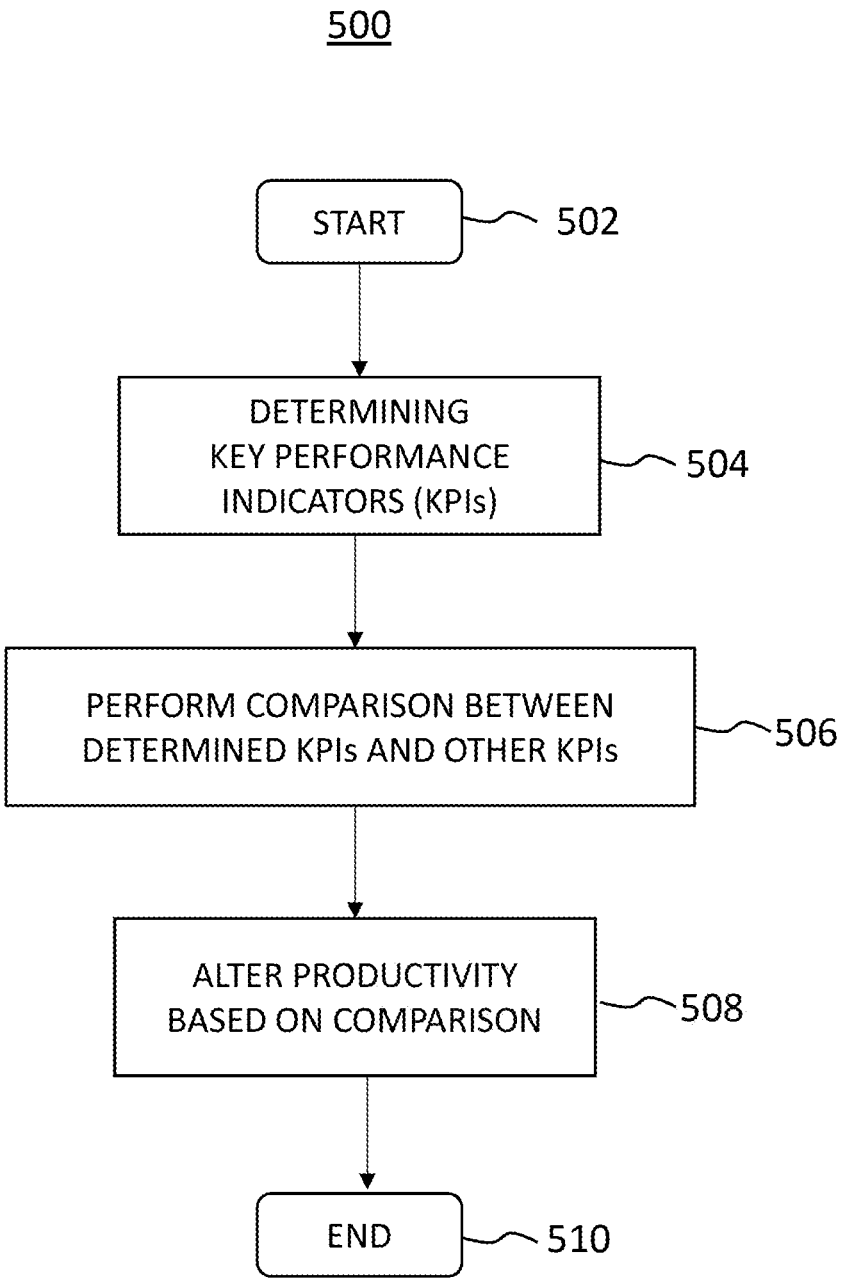
FIG. 5 depicts a flow chart of a method in accordance with several aspects described herein.

Based on the KPIs in to KPI module 404, an operator can assess the productivity of the drilling apparatus 112. Furthermore, as shall be generally described in regards to the method 500 shown in FIG. 5, the computer 102 or 108 can receive KPI modules from other drilling apparatuses to provide a comparison between the KPI module 404 and the other KPI modules. As such, if another KPI module is judged to be more advantageous, the control system 116 can be instructed to change equipment parameters associated with the process 312 to cause the KPIs in the KPI module 404 to converge to those of the other KPI module. In other words, the drilling process of the drilling apparatus 112 can be optimized based on KPIs from a similar system. This optimization can be undertaken in a feedback loop.

Figure 4:
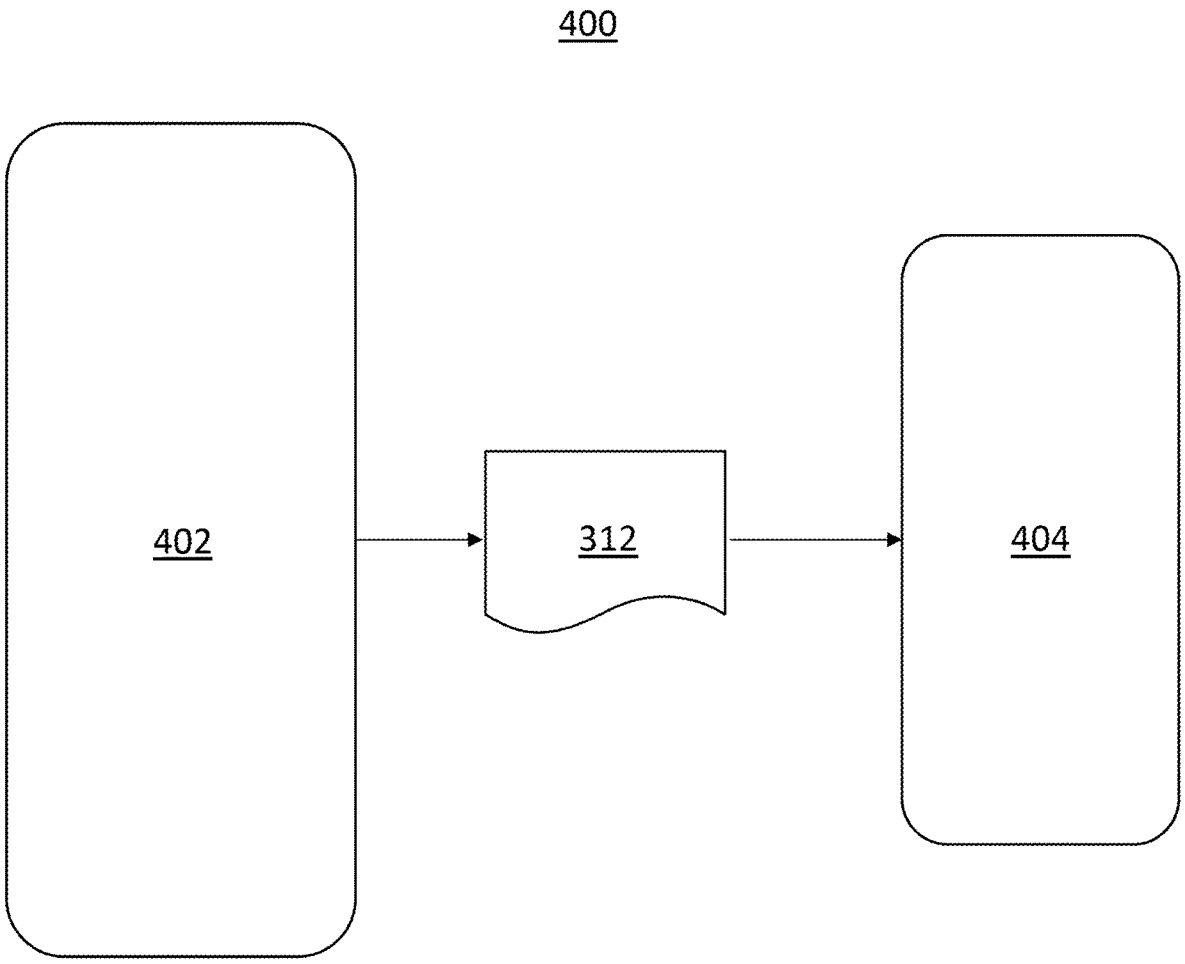
FIG. 4 depicts a flow chart of a method in accordance with several aspects described herein.

The method 500 can be generally used for analyzing and controlling a productivity of the drilling apparatus 112 utilizing the control system 116 cooperatively with the control terminals and computers described with respect to the environment 100. The exemplary method 500 can begin at step 502, and it can include (at step 504) determining a key performance metric based on information received by the control system 116. The information can be indicative of a state of the drilling apparatus 112, e.g., the information can be tag module 402 illustrated in FIG. 4.

The method 500 can further include performing a comparison between the key performance metric and at least one other key performance metric (step 506). Lastly, the method 500 can include altering, by the control system 116 and based on the comparison, the productivity of the drilling apparatus 112 (step 508).

For example, if the key performance metric of the drilling apparatus 112 falls below the key performance metric of the other drilling apparatus, the control system 116 can be instructed to increase a speed or another parameter so that the key performance metric of the other drilling apparatus. This serves as a reference KPI for optimization. The method 500 then ends at step 510.

Figure 6:
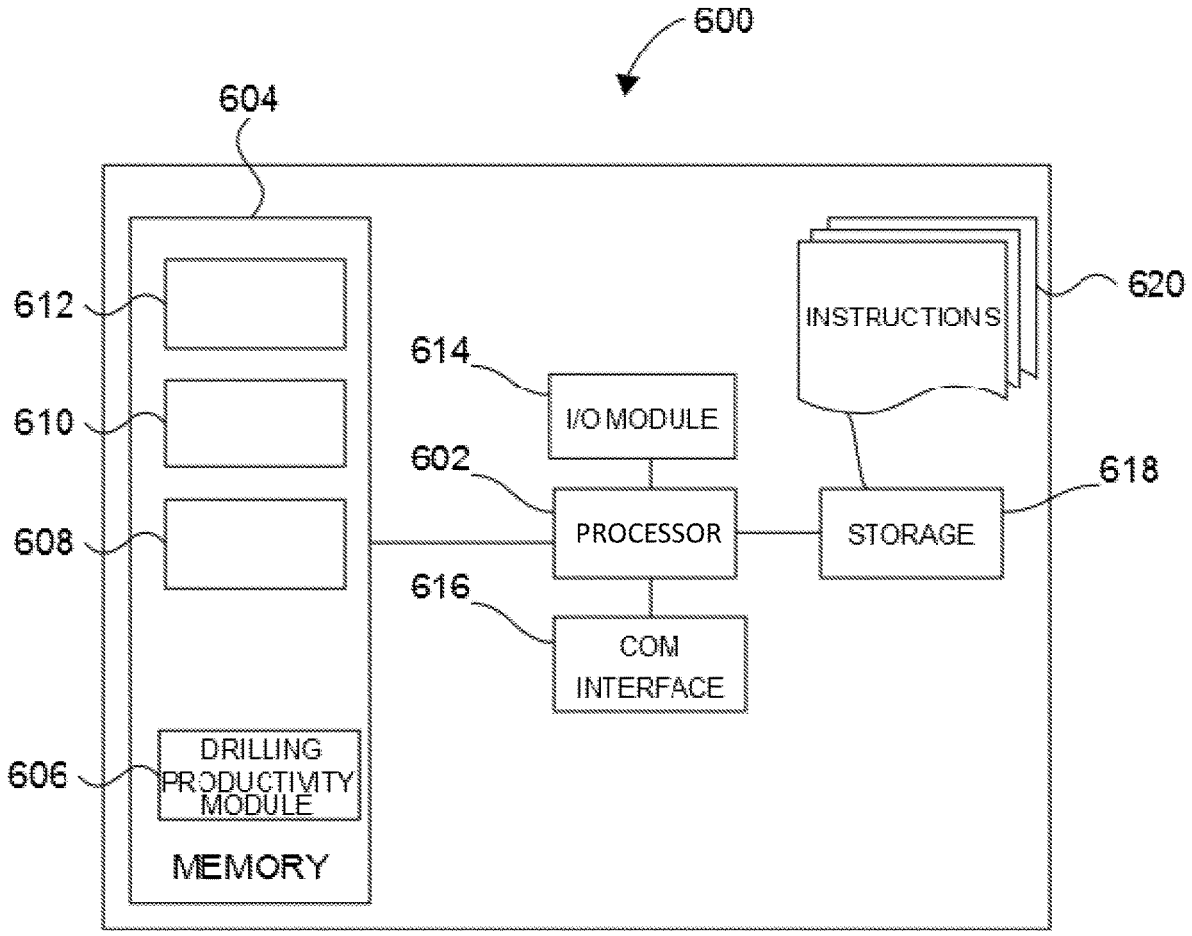
FIG. 6 depicts a system in accordance with several aspects described herein.

Having set forth various exemplary embodiments, a controller 600 (or system) consistent with their operation is now described. FIG. 6 shows a block diagram of the controller 600, which can include a processor 602 that has a specific structure. The specific structure can be imparted to the processor 602 by instructions stored in a memory 604 included therein and/or by instructions 620 that can be fetched by processor 612 from a storage medium 618. The storage medium 618 may be co-located with the controller 600 as shown, or it may be located elsewhere and be communicatively coupled to the controller 600.

The controller 600 can be a stand-alone programmable system, or it can be a programmable module located in a much larger system. For example, the controller 600 can be part of the control system 116 or be located in an offshore or onshore drilling management system. The controller 600 may include one or more hardware and/or software components configured to fetch, decode, execute, store, analyze, distribute, evaluate, and/or categorize information. Furthermore, the controller 600 can include an input/output (I/O) module 614 that can be configured to interface with a plurality of offshore and/or onshore computing systems.

The processor 602 may include one or more processing devices or cores (not shown). In some embodiments, the processor 602 may be a plurality of processors, each having either one or more cores. The processor 602 can be configured to execute instructions fetched from the memory 604, i.e. from one of memory blocks 612, 610, 608, or memory block 606, or the instructions may be fetched from the storage medium 618, or from a remote device connected to the controller 600 via a communication interface 616.

Furthermore, without loss of generality, the storage medium 618 and/or the memory 604 may include a volatile or non-volatile, magnetic, semiconductor, tape, optical, removable, non-removable, read-only, random-access, or any type of non-transitory computer-readable computer medium. The storage medium 618 and/or the memory 604 may include programs and/or other information that may be used by the processor 602. Furthermore, the storage medium 618 may be configured to log data processed, recorded, or collected during the operation of controller 600. The data may be time-stamped, location-stamped, cataloged, indexed, or organized in a variety of ways consistent with data storage practice.

In one embodiment, for example, the memory block 606 may include instructions that, when executed by the processor 602, cause processor 602 to perform certain operations. In other words, the memory 606 may be a drilling productivity control module. The operations can include receiving information from a control system of the drilling apparatus and determining a key performance metric based on the information. The operations can further include performing a comparison between the key performance metric and at least one other key performance metric. Furthermore, the operations can further include instructing, based on the comparison, the control system 116 to alter the productivity of the drilling apparatus.

Generally, the embodiments can include a system (and a method of using such system) for analyzing and controlling a productivity of a drilling apparatus. The exemplary system includes a processor and a memory including instructions that cause the processor to perform certain operations. The operations can include receiving information from a control system of the drilling apparatus and determining a key performance metric based on the information. The operations can further include performing a comparison between the key performance metric and at least one other key performance metric. Furthermore, the operations can further include instructing, based on the comparison, the control system to alter the productivity of the drilling apparatus.

The key performance metric may be associated with a process selected from the group consisting of drilling, tripping in, tripping out, running riser, pulling riser, running casing, and wireline. Furthermore, the key performance metric may be associated with a sub-process of the process. Moreover, the at least one other key performance metric may be associated with another drilling apparatus, such as a drilling apparatus located on another vessel or on another drilling platform. The at least one other key performance metric may be selected from the group consisting of drilling, tripping in, tripping out, running riser, pulling riser, running casing, and wireline.

Moreover, the key performance metric may be selected from the group consisting of WOB, block position, block weight, AHC Mode, AHC position, ROP, top drive speed, top drive torque, stand pipe pressure, mud pump SPM, mud pump discharge pressure, total SPM, mud return, gain/loss alarms, mud pump designation, average ROP per stand, WOB to WOB, net ROP improvement. Furthermore, the key performance metric may be determined based on one or more equipment tags reported by the control system.

In some embodiments, the operations further include determining an identity of an ongoing process. An exemplary system can thus include a human machine interface that is configured for displaying the ongoing process for an operator to visualize. For example, and not by limitation, the ongoing process may be displayed in the human machine interface in one of a fishbone graphic, a pie chart, and a time graph, or generally, through any other data visualization scheme known in the art.

Furthermore without limitation, the human machine interface can be a graphical user interface that allows the operator to view processes, key performance metrics, operational information and the like. The human machine interface may also include interactive features that allows the operator to alter the productivity of the drilling apparatus based on the received KPIs and/or KPIs associated with other drilling apparatuses.

As such, the human machine interface may also be configured to display one or more other ongoing processes associated with the at least one other drilling apparatus. And the human machine interface can also display operational data.

In the exemplary system, the processor's operations can further include generating an alert based on the comparison. For example, the alert may be generated based on the comparison exceeding or falling below a predetermined threshold.

Those skilled in the relevant art(s) will appreciate that various adaptations and modifications of the embodiments described above can be configured without departing from the scope and spirit of the disclosure. Therefore, it is to be understood that, within the scope of the appended claims, the disclosure may be practiced other than as specifically described herein.

What is claimed is:

1. A system for analyzing and controlling a productivity of a drilling apparatus deployed at a location, the system comprising:

a control system comprising:

a processor;

a memory including instructions that, when executed by the processor, cause the processor to perform operations including:

receiving information via the control system of the drilling apparatus specifically identifying an ongoing process currently being performed by selecting from a set of identifiable processes, along with sensor data associated with the ongoing process identified;

determining a key performance metric of the ongoing process based on the information and assessing the productivity of the drilling apparatus;

performing a comparison between the key performance metric of the ongoing process associated with the drilling apparatus and another key performance metric associated with another drilling apparatus deployed at another location, the other drilling apparatus being a similar system as that of the drilling apparatus; and based on the comparison when the key performance metric of the drilling apparatus is below the other key performance metric associated with the other drilling apparatus, then altering, via the control system, equipment parameters associated with the ongoing process currently being performed by the drilling apparatus to that of the other key performance metric associated with the other drilling apparatus automatically via a feedback loop, to optimize operation of the ongoing process currently being performed by the drilling apparatus, and thereby alter the productivity of the drilling apparatus.

2. The system of claim 1, wherein the ongoing process is selected from the group including drilling, tripping in, tripping out, running riser, pulling riser, running casing, and wireline.

3. The system of claim 2, wherein the key performance metric is associated with a sub-process of the ongoing process.

4. The system of claim 1, further including a human machine interface, and wherein the operations further include displaying the ongoing process on the human machine interface.

5. The system of claim 4, wherein the ongoing process is displayed in the human machine interface in one of a fishbone graphic, a pie chart, and a time graph.

6. The system of claim 5, wherein the human machine interface is configured to display one or more other ongoing processes associated with the at least one other drilling apparatus.

7. The system of claim 5, wherein the human machine interface is further configured to display operational data.

8. The system of claim 1, wherein the operations further include generating an alert based on the comparison.

9. The system of claim 8, wherein the alert is generated based on the comparison exceeding or falling below a predetermined threshold.

10. The system of claim 1, wherein the key performance metric is selected from the group including weight on bit (WOB), block position, block weight, active heave compensation (AHC) Mode, AHC position, rate of penetration (ROP), top drive speed, top drive torque, stand pipe pressure, mud pump strokes per minute (SPM), mud pump discharge pressure, total SPM, mud return, gain/loss alarms, mud pump designation, average ROP per stand, WOB to WOB, and net ROP improvement.

11. The system of claim 1, wherein the key performance metric is determined based on one or more equipment tags reported by the control system.

12. A method for analyzing and controlling a productivity of a drilling apparatus deployed at a location utilizing a control system interfaced with the drilling apparatus, the method comprising:

receiving information via the control system of the drilling apparatus, specifically identifying an ongoing process currently being performed by selecting from a set of identifiable processes, along with sensor data associated with the ongoing process;

determining a key performance metric of the ongoing process based on information received by the control system, the information being indicative of a state of the drilling apparatus;

performing a comparison between the key performance metric of the ongoing process associated with the drilling apparatus and another key performance metric associated with another drilling apparatus deployed at another location, the other drilling apparatus being a similar system as that of the drilling apparatus; and based on the comparison when the key performance metric associated with the drilling apparatus is below the key performance metric associated with the other drilling apparatus then altering, by the control system equipment parameters associated with the ongoing process being performed by the drilling apparatus to that of the other key performance metric associated with the other drilling apparatus automatically via a feedback loop, to optimize operation of the ongoing process currently being performed by the drilling apparatus, and thereby alter the productivity of the drilling apparatus.

13. The method of claim 12, wherein the key performance metric is associated with the ongoing process selected from the group including drilling, tripping in, tripping out, running riser, pulling riser, running casing, and wireline.

14. The method of claim 13, wherein the key performance metric is selected from the group including weight on bit (WOB), block position, block weight, active heave compensation (AHC) Mode, AHC position, rate of penetration (ROP), top drive speed, top drive torque, stand pipe pressure, mud pump strokes per minute (SPM), mud pump discharge pressure, total SPM, mud return, gain/loss alarms, mud pump designation, average ROP per stand, WOB to WOB, and net ROP improvement.

* * * * *